US006922969B1

(12) United States Patent
Mina

(10) Patent No.: US 6,922,969 B1
(45) Date of Patent: Aug. 2, 2005

(54) ARRANGEMENT FOR CONFIGURING BUILDING ELEMENTS

(76) Inventor: Marino Sanchez Mina, Siro, 8, E-28007 Madrid (ES)

( * ) Notice: Subject to any disclaimer, the term of this patent is extended or adjusted under 35 U.S.C. 154(b) by 0 days.

(21) Appl. No.: 10/031,250

(22) PCT Filed: Sep. 13, 2000

(86) PCT No.: PCT/ES00/00343

§ 371 (c)(1),
(2), (4) Date: Jun. 27, 2002

(87) PCT Pub. No.: WO01/63067

PCT Pub. Date: Aug. 30, 2001

(30) Foreign Application Priority Data

Feb. 23, 2000 (ES) ..... 200000423

(51) Int. Cl.[7] ..... E01C 3/29

(52) U.S. Cl. ..... 52/738.1; 52/737.4; 52/731.7; 52/309.16

(58) Field of Search ..... 52/738.1, 737.4, 52/731.7, 732.1, 309.15, 309.16

(56) References Cited

U.S. PATENT DOCUMENTS

| | | | | | |
|---|---|---|---|---|---|
| 2,855,021 | A | * | 10/1958 | Hoppe | 156/78 |
| 3,778,949 | A | | 12/1973 | Hellrich | |
| 3,810,337 | A | * | 5/1974 | Pollard | 52/223.8 |
| 3,983,205 | A | | 9/1976 | Barrett | |
| 4,081,941 | A | * | 4/1978 | Van Ausdall | 52/726.2 |
| 4,289,303 | A | | 9/1981 | Hamm | |
| 4,461,134 | A | * | 7/1984 | Lowe | 52/731.7 |
| 4,606,167 | A | * | 8/1986 | Thorne | 52/737.4 |
| 4,981,004 | A | * | 1/1991 | Weber | 52/738.1 |
| 5,379,567 | A | * | 1/1995 | Vahey | 52/724.5 |
| 5,471,809 | A | * | 12/1995 | Frankel | 52/737.4 |
| 6,505,454 | B2 | * | 1/2003 | Dingler | 52/729.5 |

FOREIGN PATENT DOCUMENTS

| | | |
|---|---|---|
| DE | 3544544 | 5/1987 |
| DE | 4106036 | 10/1998 |
| DE | 19818769 | 11/1999 |
| GB | 0785283 | 10/1957 |
| JP | 7317209 | 12/1995 |

* cited by examiner

*Primary Examiner*—Carl D. Friedman
*Assistant Examiner*—Basil Katcheves
(74) *Attorney, Agent, or Firm*—Horst M. Kasper

(57) ABSTRACT

An improved arrangement to configure construction components consisting of the combination of metal and plastic to obtain a product with more mechanical properties than those of the separate materials, constituted by an internal metal structure covered by a plastic surrounding (2) or (12) or (22) or (32) or (42) or (52) or (62) or (72) or (82) or (92) or (102) or (112) to which, a metallic laminate is joined (4) and (4') or (84) or (114) and (114') for reinforcement in the bolted joints, applying the resulting composite in the manufacture of rails and beams (1), pipes (10), rods (20), channels (30), angles (40), flatbars (50), "Z" (60), profiles (70), beams (80), corrugated plates (90), smooth plates (100) or structures (110).

20 Claims, 9 Drawing Sheets

ARRANGEMENT FOR CONFIGURING BUILDING ELEMENTS

OBJECT OF THE INVENTION

The present specification refers to an application for patent of Invention regarding an improved arrangement to configure construction components, whose basic interests lies in providing a combination of metal and plastic, allowing the manufacture of construction parts achieving an assembly with properties which would not be possible by using said materials separately.

FIELD OF THE INVENTION

This invention is applicable to the industry dedicated to the manufacture of structural construction components for general use in engineering and architecture.

BACKGROUND OF THE INVENTION

The existence of concrete made from a mixture of cement, water, aggregates and additives is known, to form parts participating in the execution of building works, it being possible to use mass concrete or reinforced concrete which improve their mechanical properties on incorporating metallic reinforcements.

However, it would be desirable to have the possibilities offered by materials like plastic, that is, to provide essential characteristics it lacks for its inclusion in this type of activity.

The applicant is not aware of arrangements with the properties and level of improvement as those of the object of the present invention.

DESCRIPTION OF THE INVENTION

The improved arrangement for the configuration of construction components has a series of advantages requiring a detailed explanation.

It is relevant to indicate that the combination of plastic with metal provides a composite having better mechanical features than those individually offered by the separate materials, it being possible to mention:

Resistance
Durability
Lightness
Colour
Resonance or minimum vibrations
Texture
Conformability
Corrosion resistance
Reduced conductivity
Economic
Easy to handle in its application and use All these features integrate the base supporting the key of the invention.

The object of the invention consists of an internal metal structure over which a plastic casting is located.

The proposed arrangement permits the limits of either component to be surpassed with the benefits offered by the other, constituting a body providing symbiosis between both materials.

The plastic used to conform the combination will be different according to the requirements of each specific situation, having a plurality of metallic components to constitute the structure located inside the external material.

Moreover, a metallic reinforcement laminate or plate is provided in the bolted joints, preventing the drawbacks they involve.

By using moulds, the casting of plastic material is achieved employing any of the processes currently used for the metallic structure to be covered by it.

The sizing and shape of the parts are determined by criteria related to the ease of practical handling, resistance, weight and economy.

The invention proposed may be used in the production of any type of part with applications directed to construction and installation in general.

DESCRIPTION OF THE DRAWINGS

To complete the description being made and to contribute to a better understanding of the features of the invention, the present specification is accompanied by three sheets of drawings showing the following with an illustrative and non-limiting character.

PREFERRRED EMBODIMENT OF THE INVENTION

Figure 1:
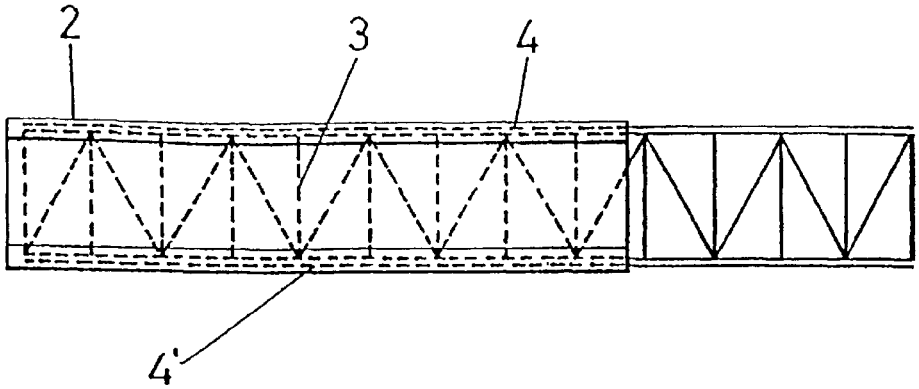
FIG. 1 shows a side elevation view or rails and beams prepared as from the improved arrangement to configure construction components.
Figure 2:
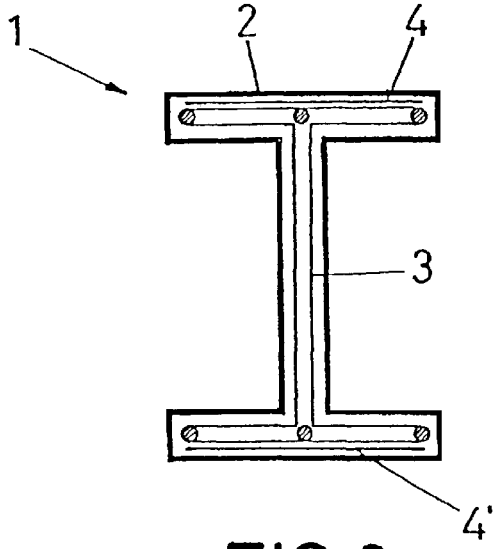
FIG. 2 shows a section view of the rail or beam considered in the previous figure, in which the plastic enveloping material, the metal plates and reinforcement may be observed.
Figure 3:
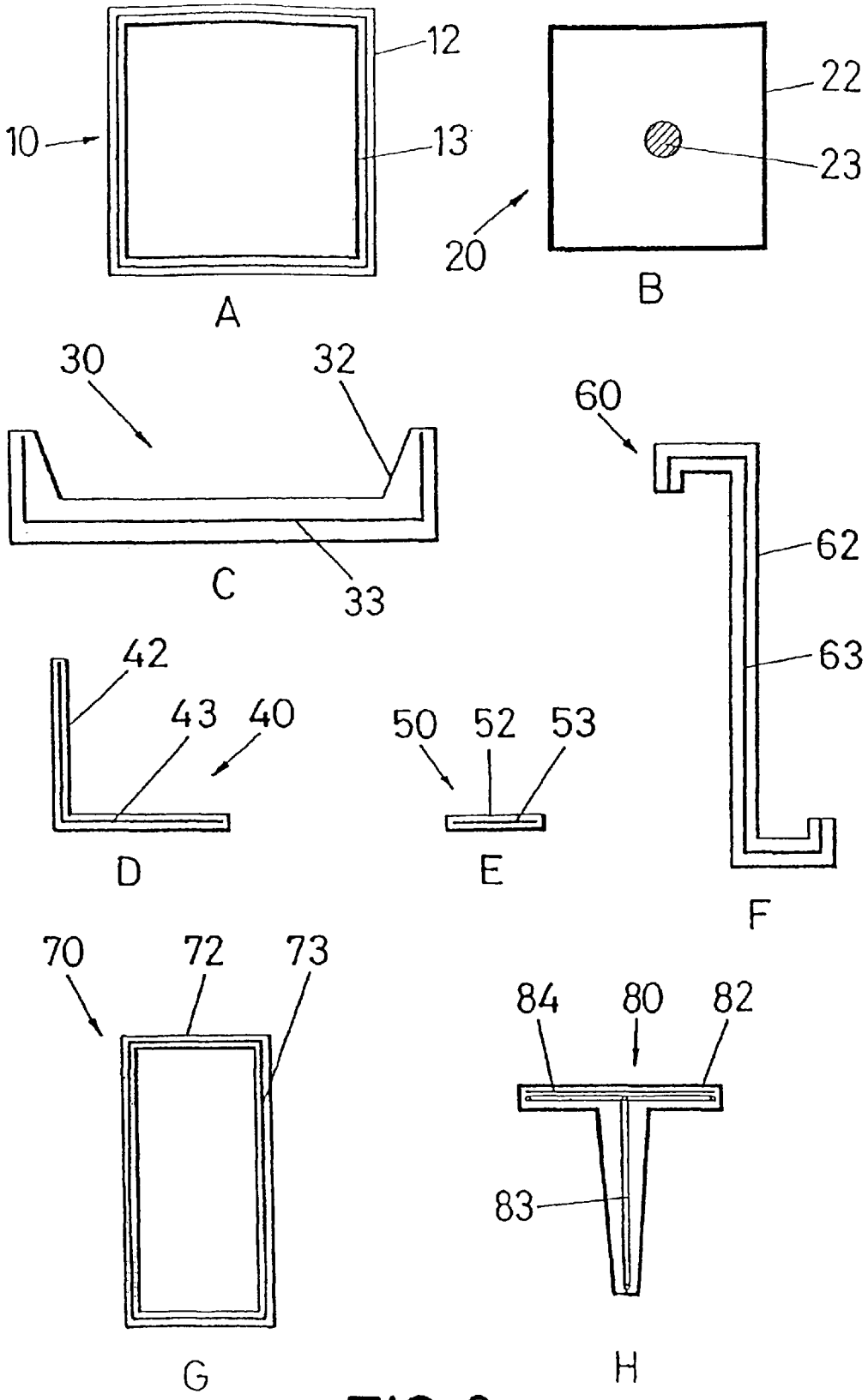
FIG. 3 shows a view of different sections in which the enveloping material and metallic components occupying the interior are distinguished, such that section A correspond to a pipe, section B to a rod, section C to a channel, section D to an angle, section E to a flatbar, section F to a "Z", section G to a profile and section H, to a beam.
Figure 4:
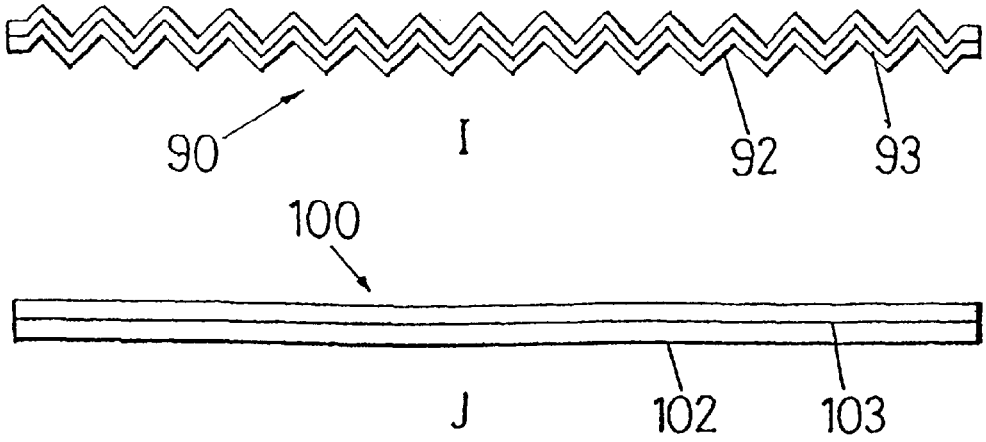
FIG. 4, contemplates a view of two sections where the outer plastic and inner metal covers are observed, such that section I represents a corrugated plate and section J, a smooth plate.
Figure 5:
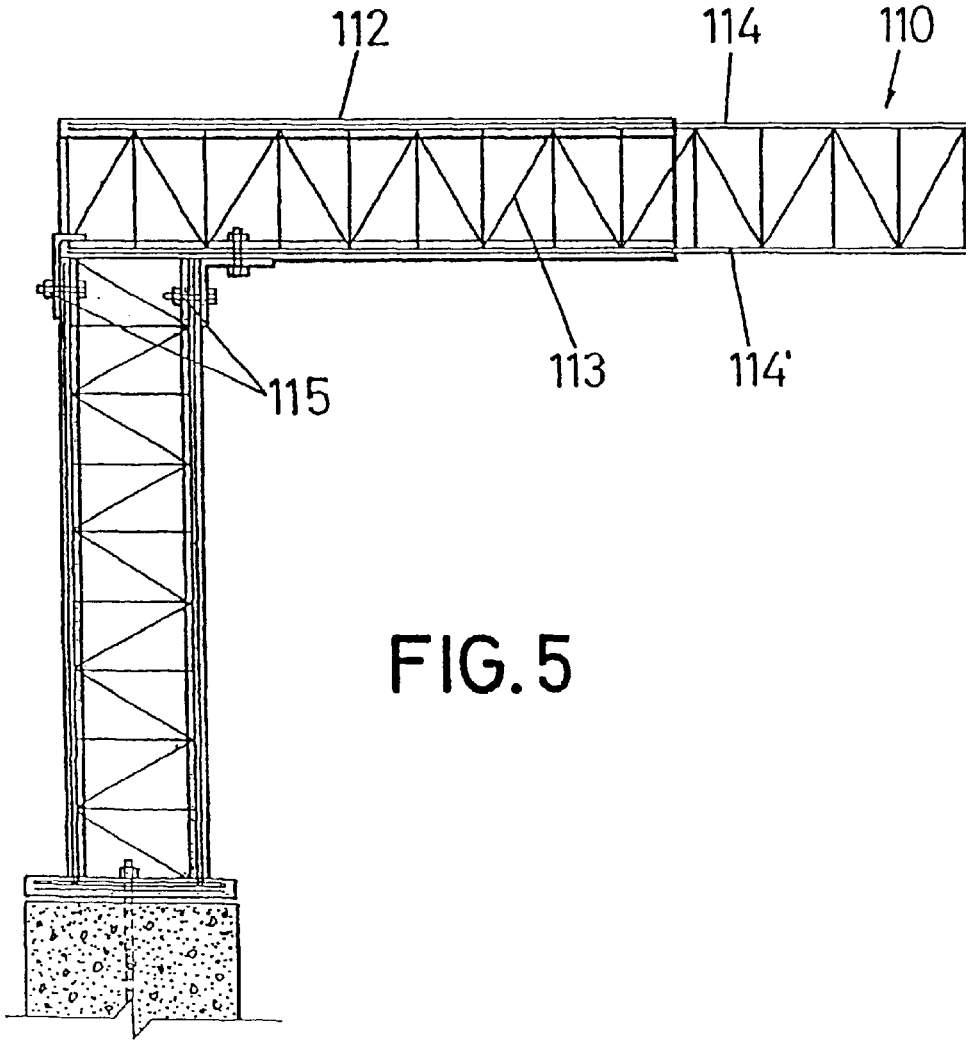
FIG. 5, refers to a side elevation view of a structure formed by a beam and a column joined by bolts.
Figure 6:
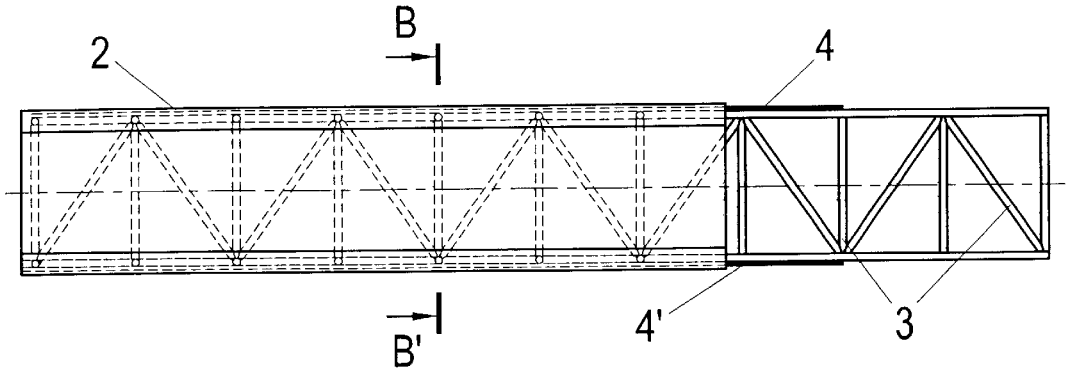
FIG. 6 us a schematic view of a connection of rails and beams.
Figure 7:
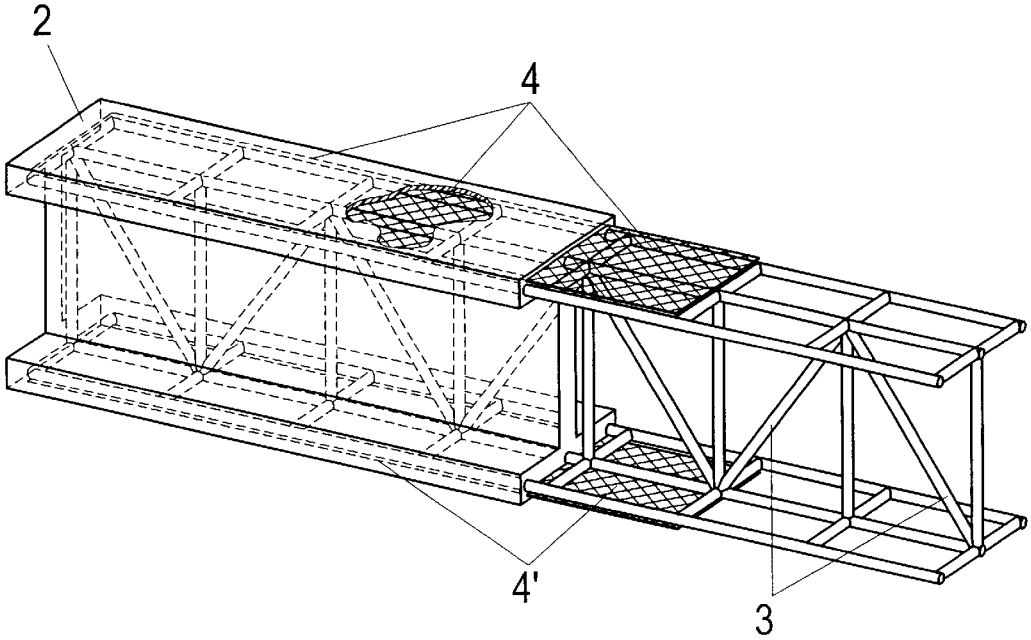
FIG. 7 shows a perspective detailed view of the rails and beams of the embodiment of FIG. 6.
Figure 8:
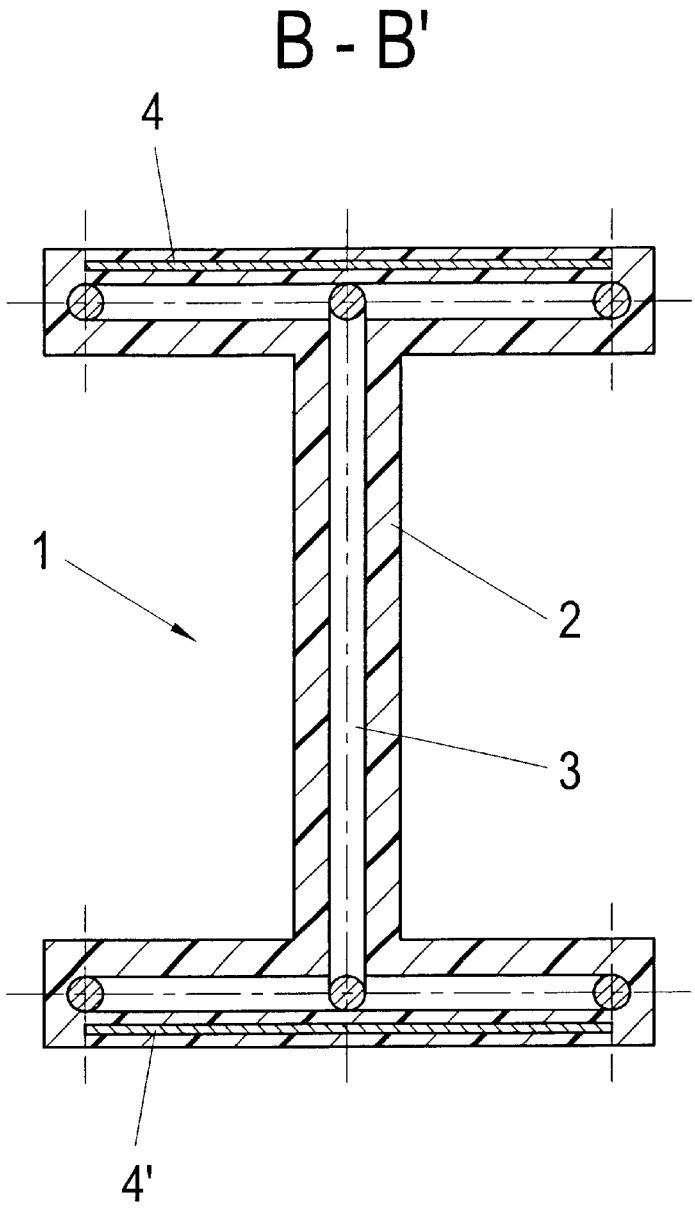
FIG. 8 shows a detailed cross-sectional view of the rails and beams.
Figure 9:
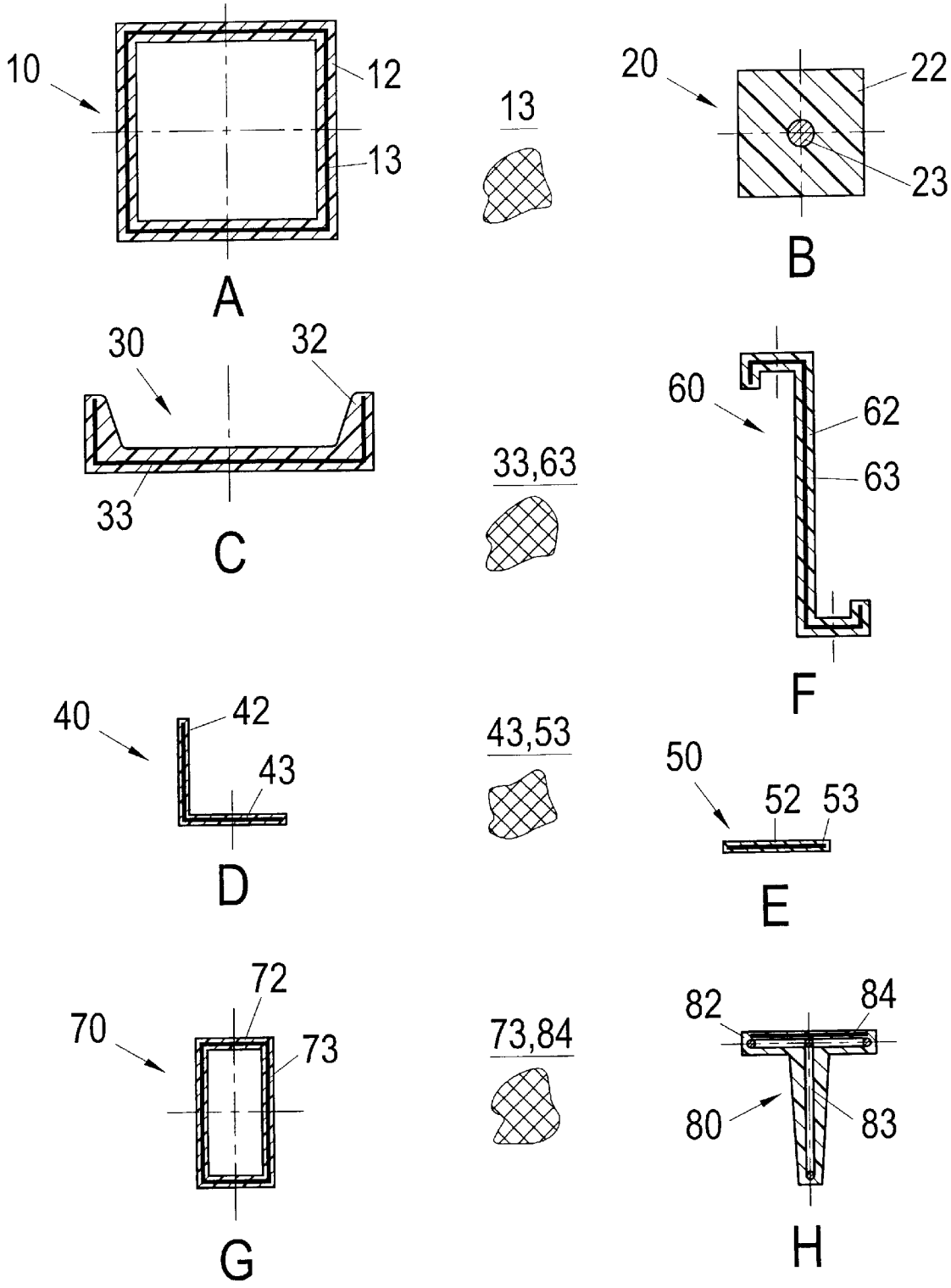
FIG. 9 illustrates different sections of the rails and beams distinguishing enveloping material and metallic components occupying the interior and their respective location.
Figure 10:
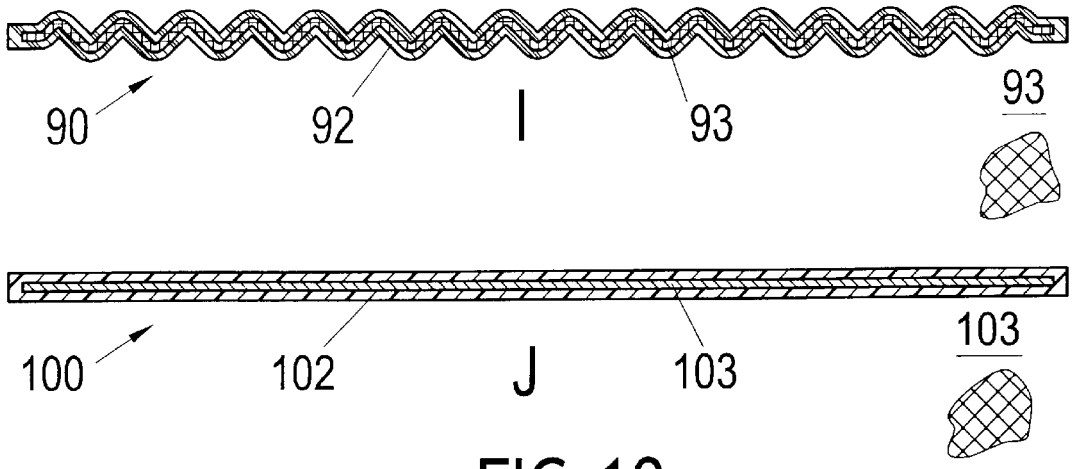
FIG. 10 shows a view of two sections and indicates their the location of the outer plastic and inner metal covers.
Figure 11:
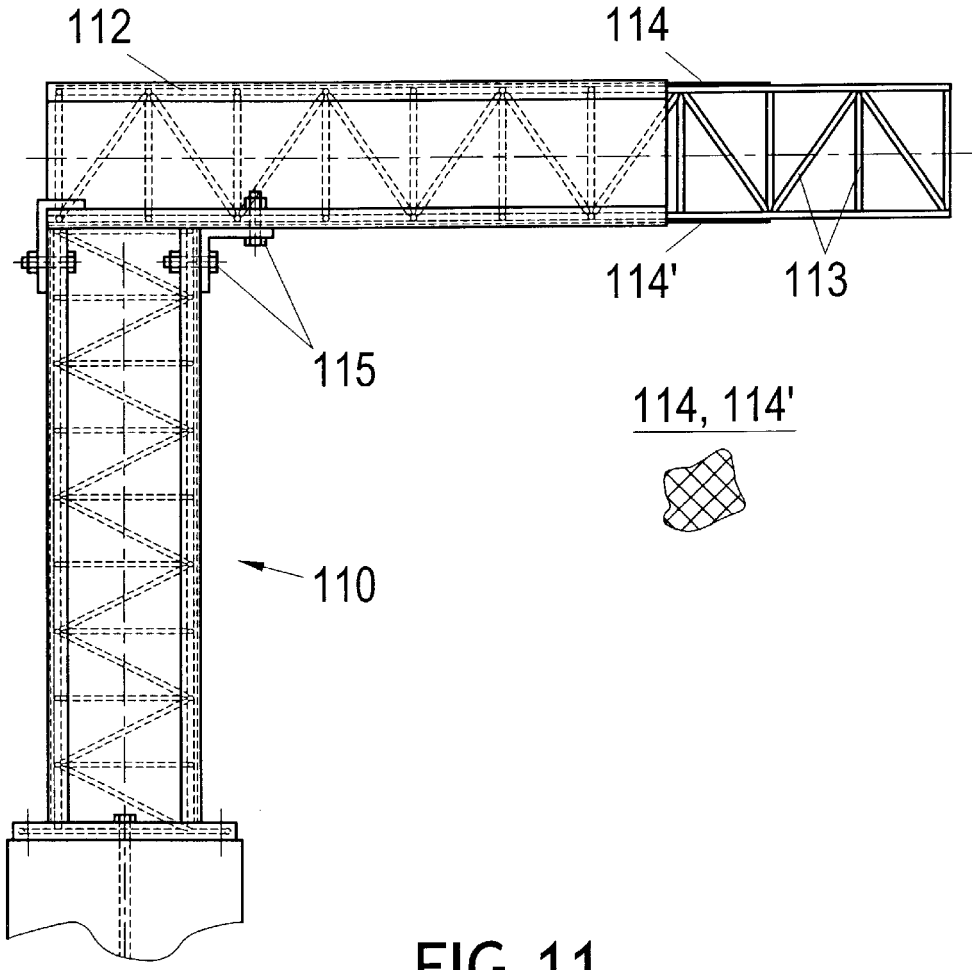
FIG. 11 shows a side elevational view of a beam and a column joined by bolts.
Figure 12:
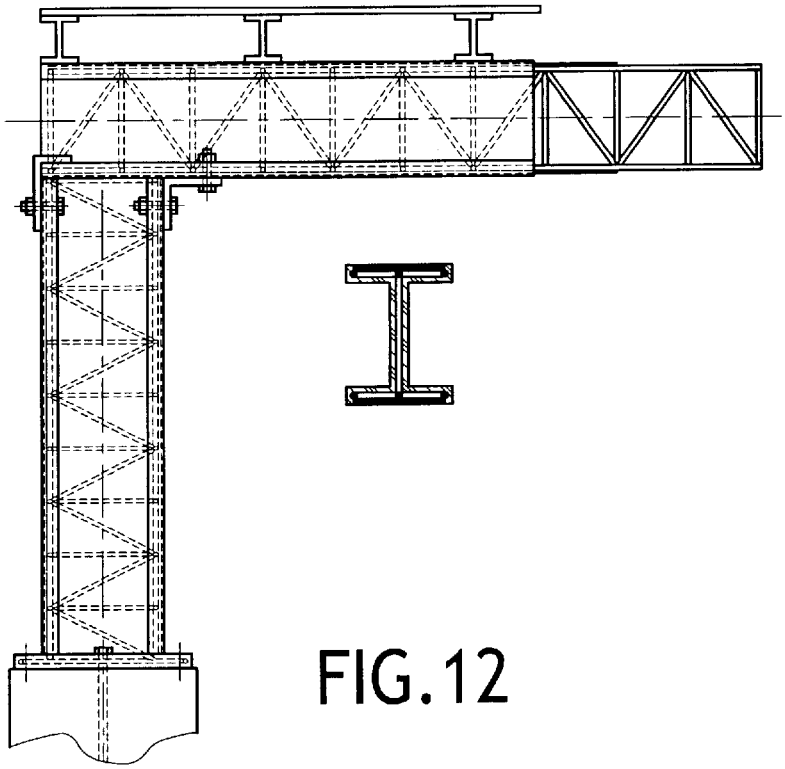
FIG. 12 shows a view of an embodiment of the invention employing an 1 beam structure.
Figure 13:
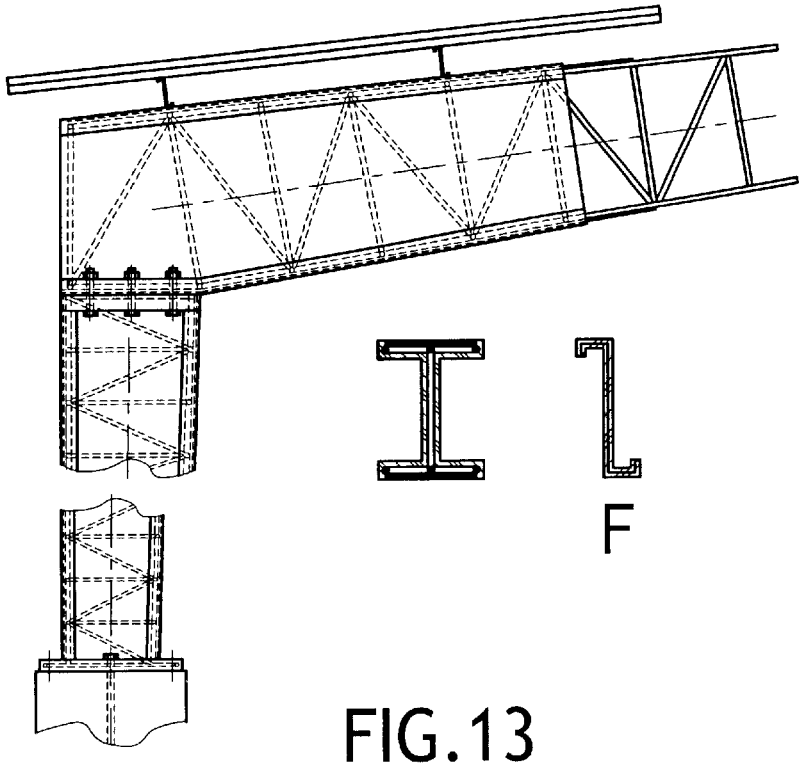
FIG. 13 shows a view of another embodiment of the invention.
Figure 14:
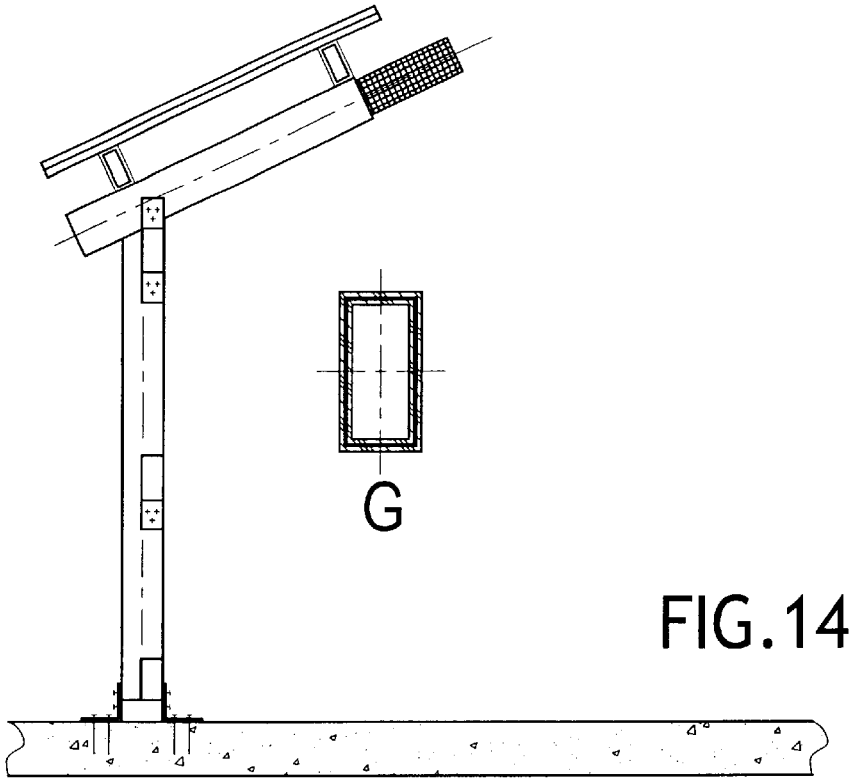
FIG. 14 shows a schematic view of another embodiment of the invention.
Figure 15:
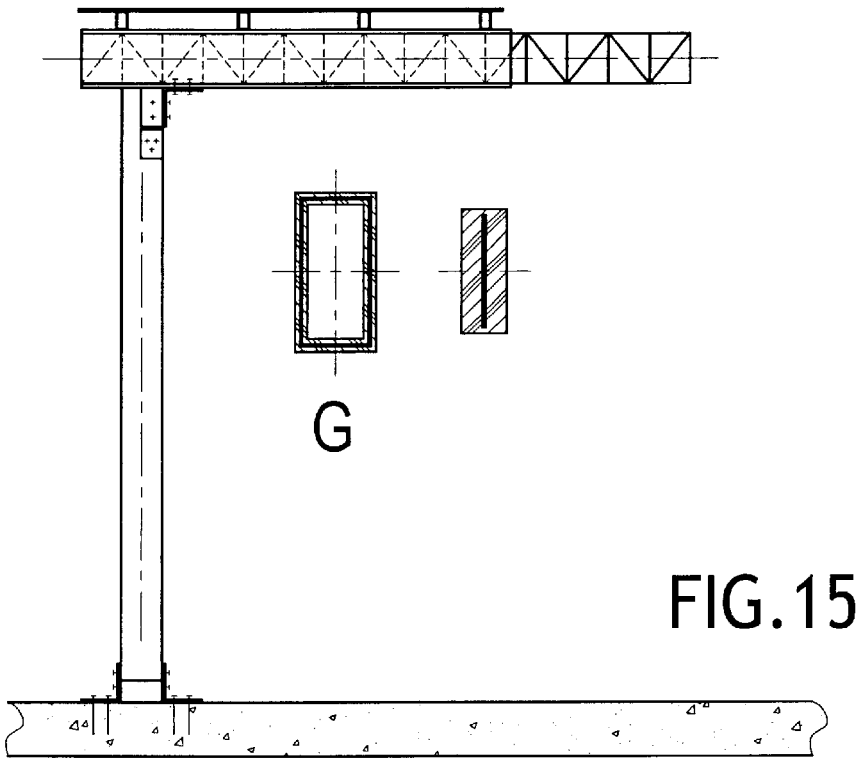
FIG. 15 shows a schematic view of another embodiment of the invention.

The improved arrangement to configure construction components is constituted as from the combination of two materials, namely plastic and metal.

The plastic used has different properties according to the types determined for each case, receiving the generic name of enveloping material (2) or (12) or (22) or (32) or (42) or (52) or (62) or (72) or (82) or (92) or (102) or (112), it being possible to mention different types of plastic resin, Thermo and Duraplastic, like phenoplastes, polycarbonate, ABS, polyethylene and resins.

On the other hand, the metallic material (3) or (13) or (23) or (33) or (43) or (53) or (63) or (73) or (83) or (93) or (103) or (113) incorporated, has any form according to the selected application, its configuration being possible as from G-40 corrugated steel with a resistance value of 2,800 $Kg/cm^2$, G-60 corrugated steel with a resistance value of 4,200 $Kg/cm^2$, rods, electrowelded meshes, reinforcements, frames or shears, zinc and aluminium plates or steel tolas, wires and cables.

The combination is produced such that inside the plastic casting (2) or (12) or (22) or (32) or (42) or (52) or (62) or (72) or (82) or (92) or (102) or (112), the metallic structure (3) or (13) or (23) or (33) or (43) or (53) or (63) or (73) or (83) or (93) or (103) or (113) is introduced, obtaining a body in which the constitutive components compensate the lacks of the individual materials.

Likewise, the existence of a metallic laminate or plate (4) and (4') or (84) or (114) and (114'), which act as a reinforcement to prevent the external plastic casting (2) or (12) or (22) or (32) or (42) or (52) or 62) or (72) or (82) or (92) or (102) or (112) from checking or splitting, problems that arise as a result of the stresses and shearing taking place in the bolted joints.

With the object of reaching the final shape, a mould is prepared permitting casting of the plastic material (2) or (12) or (22) or (32) or (42) or (52) or (62) or (72) or (82) or (92) or (102) or (112), the component enveloping the internal metallic structure (3) or (13) or (23) or (33) or (43) or (53) or (63) or (73) or (83) or (93) or (103) or (113), using for this object any of the methods permitted.

It is reasonable to make use of processes like casting by injection, extrusion, direct casting, by transfer or cold.

In the joints or extensions of the parts or components, a fastening will be used that permits the determined resistance and statism making use of plates and bolts, assemblies, plastic-resistant adhesives or combinations of the above.

The composite proposed may be used in the production of rails and beams (1), pipes (10), rods (20), channels (30), angles (40), flatbars (50), "Z" (60), profiles (70), beams (80), corrugated plates (90), smooth plates (100) or structures (110) in which bolts (115) exist which join the beam and the column.

It is not considered necessary to extend this description for any expert in the matter to understand the scope of the invention and the advantages derived from it.

The materials, shape, size and arrangement of the components may be varied, provided this does not change the essentiality of the invention.

The terms in which the report specification been written should always be interpreted in the widest and non-limiting sense.

What is claimed is:

1. An improved arrangement to configure construction components characterised on being constituted as from a combination of plastic and metal, consisting of a plastic enveloping casting molded around and adhering to and surrounding an internal metallic structure of a certain thickness and having a peripheral part of the internal metallic structure, said plastic enveloping casting also being molded around and adhering to and surrounding and incorporating a metallic laminate or plate disposed substantially parallel to the peripheral part of the internal metallic structure and disposed at a closely spaced distance from the peripheral part of the internal metallic structure not larger than twice the thickness of the internal metallic structure for reinforcement in bolted joints.

2. A construction component comprising an internal metallic structure exhibiting a planar face;

metallic reinforcement rods passing through the metallic structure;

a metallic laminate disposed parallel to the planar face;

a plastic enveloping casting molded around, surrounding, and adhering to the internal metallic structure and the metallic laminate;

bolted joints passing through the metallic laminate, wherein the metallic laminate furnishes a reinforcement.

3. The construction component according to claim 2, wherein the construction component assumes a form of channels (30), angles (40), flatbars (50), or "Z"-shapes (60).

4. The construction component according to claim 2, wherein the construction component assumes a form of profiles (70), or beams (80).

5. The construction component according to claim 2, wherein the construction component assumes a form of corrugated plates (90), smooth plates (100) or structures (110).

6. The construction component according to claim 2 wherein the internal metallic structure is of T-shape, and wherein the planar face is the top of the T.

7. The construction component according to claim 2 wherein the internal metallic structure is of T-shape, and wherein the plastic enveloping casting increases in thickness from the bottom of the stem of the T to the top of the stem of the T.

8. An I-beam structure comprising a metallic I-beam having an upper face and having a lower face;

a first metallic laminate disposed above the upper face at a distance;

a second metallic laminate disposed below the lower face at a second distance;

a cast plastic envelope molded around and surrounding the metallic I-beam, the first metallic laminate, and the second metallic laminate and having an outer shape of an I-beam.

9. The I-beam structure according to claim 8 wherein the cast plastic envelope comprises a member of the group consisting of phenoplastes, polycarbonate, polyethylene, resins and mixtures thereof, and further comprising metallic reinforcement rods disposed at outer edges and at inner edges of the metallic I-beam.

10. A construction component comprising an internal metallic structure incorporating metallic reinforcement rods and exhibiting a planar face;

a metallic laminate plate disposed in front of the planar face;

a plastic enveloping casting molded around, surrounding, and adhering to the internal metallic structure and the metallic laminate plate.

11. The construction component according to claim 10 wherein the internal metallic structure includes a channel.

12. The construction component according to claim 10 wherein the internal structure is of a Z-shaped cross-section.

13. The construction component according to claim 10 wherein the internal structure is profile having a rectangular cross-section.

14. The construction component according to claim 10 wherein the internal structure is made of a corrugated steel G-40 having a resistance value of 2,800 Kg/cm$^2$.

15. The construction component according to claim 10 wherein the plastic of the plastic enveloping casting is a member selected from the group consisting of thermoplastic, duraplastic, phenoplastic, polycarbonate, ABS, polyethylene and resins.

16. The construction component according to claim 10 wherein the internal metallic structure is selected from the group of forms consisting of rails, beams, channels, angles, flatbars, "Z"-shaped profiles, profiles, corrugated plates, smooth plates and flat structures.

17. The construction component according to claim 10 wherein the internal structure is a member selected from the group consisting of rods, electrowelded meshes, reinforcements, frames, shears, zinc plates, aluminium plates, steel tolas, wires, and cables.

18. The construction component according to claim 10 wherein the internal structure is made of a corrugated steel G-60 having a resistance value of about 4,200 Kg/cm$^2$.

19. An improved arrangement to configure construction components
comprising an internal metallic structure forming a profile having a direction including metallic reinforcing rods defining end edges in the direction of the profile and junction edges defining internal junctions of the profile;

a plurality of plate shaped metallic structures connecting the metallic reinforcing rods such that each metallic reinforcing rod is attached to one plate shaped metallic structure or attached to three plate shaped metallic structures;

a metallic laminate plate disposed on the outside of one reinforcing rod attached to three plate shaped metallic structures and disposed on the outside of two of the three plate shaped metallic structures attached to the one reinforcing rod for reinforcement in bolted joints; and a plastic enveloping casting surrounding the internal metallic structure such that the internal metallic structure is embedded in the plastic enveloping casting by being molded with the plastic of the enveloping casting.

20. The improved arrangement according to claim 19 for forming an I-beam structure wherein the metallic reinforcement rods are furnished as a first three metallic reinforcement rods disposed in parallel at equal distances from each other, defining a first middle metallic reinforcement rod and two first outer metallic reinforcement rods, and spanning a first plane and as a second three metallic reinforcement rods disposed in parallel at said equal distances from each other, defining a second middle metallic reinforcement rod and two second outer metallic reinforcement rods, and spanning a second plane, wherein the first plane is disposed parallel to the second plane and wherein the first three reinforcement rods project onto the second three metallic reinforcement rods in a projection from the first plane in a direction perpendicular onto the second plane;

wherein the plurality of plate shaped metallic structures includes first two plate shaped metallic structures disposed between the first middle metallic reinforcing rod and the respective two first outer metallic reinforcing rods;

second two plate shaped metallic structures disposed between the second middle metallic reinforcing rod and the respective two second outer metallic reinforcing rods;

a connecting plate shaped metallic structure disposed between the first middle metallic reinforcing rod and the second middle reinforcing rod thereby forming a metallic I-beam;

wherein the metallic laminate plate is disposed neighbouring to that side of the first two plate shaped metallic structures disposed relative remote to the connecting plate shaped metallic structure, and further comprising a second metallic laminate plate is disposed neighboring to that side of the second two plate shaped metallic structures disposed relative remote to the connecting plate shaped metallic structure, wherein a cast plastic envelope is molded around and surrounds the metallic I-beam, the first metallic laminate plate and the second metallic laminate plate and said cast plastic envelope having an outer shape of an I-beam.

* * * * *

UNITED STATES PATENT AND TRADEMARK OFFICE

CERTIFICATE OF CORRECTION

PATENT NO. : 6,922,969 B1
DATED : August 2, 2005
INVENTOR(S) : Nina

It is certified that error appears in the above-identified patent and that said Letters Patent is hereby corrected as shown below:

Title page,
Item [12], should read -- Nina --.
Item [76], Inventor, should read -- Marino Sanchez Nina --.

Signed and Sealed this

First Day of November, 2005

JON W. DUDAS
*Director of the United States Patent and Trademark Office*